US005104113A

United States Patent [19]

Kameyama et al.

[11] Patent Number: 5,104,113

[45] Date of Patent: Apr. 14, 1992

[54] SHEET MATERIAL SEPARATING DEVICE HAVING A PIVOTABLE SEPARATING MEMBER

[75] Inventors: Toru Kameyama, Tokyo; Koichi Miyamoto, Yokohama, both of Japan

[73] Assignee: Canon Kabushiki Kaisha, Tokyo, Japan

[21] Appl. No.: 752,900

[22] Filed: Aug. 26, 1991

Related U.S. Application Data

[63] Continuation of Ser. No. 676,468, Mar. 27, 1991, abandoned, which is a continuation of Ser. No. 369,143, Jun. 21, 1989, abandoned.

[30] Foreign Application Priority Data

Jun. 22, 1988 [JP] Japan ..... 63-153801

[51] Int. Cl.[5] ..... B65H 3/52

[52] U.S. Cl. ..... 271/124; 271/167

[58] Field of Search ..... 271/121, 124, 125, 167

[56] References Cited

U.S. PATENT DOCUMENTS

| | | | |
|---|---|---|---|
| 4,175,741 | 11/1979 | Colglazier | 271/124 X |
| 4,535,981 | 8/1985 | Watanabe et al. | 271/121 |
| 4,565,361 | 1/1986 | Tanaka et al. | 271/121 |
| 4,588,182 | 5/1986 | Nakanishi | 271/121 |
| 4,865,306 | 9/1989 | Himegi | 271/124 X |

FOREIGN PATENT DOCUMENTS

| | | | |
|---|---|---|---|
| 2320319 | 12/1973 | Fed. Rep. of Germany | 271/124 |
| 2332034 | 1/1975 | Fed. Rep. of Germany . | |
| 2719182 | 11/1978 | Fed. Rep. of Germany . | |
| 3309985 | 2/1984 | Fed. Rep. of Germany . | |
| 2283842 | 9/1975 | France . | |
| 2378706 | 2/1978 | France . | |
| 58-176828 | 11/1983 | Japan . | |
| 0116437 | 5/1987 | Japan | 271/121 |

OTHER PUBLICATIONS

European Search Report (2 pages).

*Primary Examiner*—Michael S. Huppert
*Assistant Examiner*—Kenneth DeRosa
*Attorney, Agent, or Firm*—Fitzpatrick, Cella, Harper & Scinto

[57] ABSTRACT

A sheet material separating device has a rotatable conveying member for conveying sheet materials in a predetermined direction, a separating member opposed to the rotatable conveying member and prohibiting passage of the sheet materials other than the sheet material which is in direct contact with the rotatable conveying member and conveyed thereby, and a support member for supporting the separating member so that the position of contact between the rotatable conveying member and the separating member is changeable in the direction of conveyance of the sheet materials.

23 Claims, 6 Drawing Sheets

SHEET MATERIAL SEPARATING DEVICE HAVING A PIVOTABLE SEPARATING MEMBER

This application is a continuation of application Ser. No. 676,468 filed Mar. 27, 1991, now abandoned, and patent application Ser. No. 369,143 filed June 21, 1989, now abandoned.

BACKGROUND OF THE INVENTION

1. Field of the Invention

This invention relates to a sheet material separating device for separating sheet materials, cut sheet materials (leaf materials) such as transfer materials, photosensitive paper sheets, electrostatic recording paper sheets and printing paper sheets) set on a paper supply portion, for example, in a printer or a copying apparatus one by one and conveying them to a processing portion such as an image forming portion.

More particularly, the present invention relates to a sheet material separating device of a construction which has a sheet material conveying member for conveying sheet materials in a predetermined direction and a sheet material separating member urged against the surface of said sheet material conveying member with a predetermined pressure force and in which of two or more sheet materials whose leading end portions have entered between said two members due to the cooperation between said two members, the sheet material which is in direct contact with the sheet material conveying member is conveyed between the contact portions of the two members by the conveying force of the sheet material conveying member and the passage of the other sheet materials is discharged by the sheet material separating member, whereby the sheet materials are separated and conveyed one by one.

2. Related Background Art

FIG. 8 of the accompanying drawings shows an example of the conventional sheet material separating device of the construction as described above In FIG. 8, the reference numeral 1 designates a paper feeding and separating roller (hereinafter referred to as the "paper feeding roller") as a sheet material conveying member rotatively driven about a shaft 1*a* in a clockwise direction indicated by arrow. This paper feeding roller 1 is a cut-away circular roller of D-shaped cross-section, and during non-feeding of paper, it stands by with its cut-away planar portion 1*b* facing downward, and is intermittently driven for one full rotation by each paper feeding signal. The reference numeral 2 denotes an auxiliary roller supported coaxially with the paper feeding roller 1. This auxiliary roller 2 has a diameter slightly smaller than the diameter of the paper feeding roller 1 and is freely rotatable relative to the shaft 1*a*.

The reference numeral 4 designates a separating unit as a sheet material separating member. The separating unit 4 comprises a friction member 3 adhesively secured to a pedestal 4*a*, and is fixedly held on the upper surface of the inwardly extending fore end portion of a paper feed guide plate 5 having its fore end portion inwardly extending to below the paper feeding roller 1. The guide plate 5 is supported for pivotal movement about a pivot shaft 5*a*, and is normally rotatively biased in a raising direction (a counter-clockwise direction) by a pull-up spring 6. By this rotative biasing force, the friction member 3 of the separating unit 4 is kept in pressure contact with the lower surface portion of the paper feeding roller 1 or the lower surface portion of the auxiliary roller 2 with a predetermined pressure force.

The reference numeral 7 denotes a sheet material cassette (only the fore end portion of which is shown) mounted on a cassette receptacle (not shown) below the paper feeding roller 1. The reference character 7*a* designates a cassette box, the reference character 7*b* denotes a cassette intermediate plate having its fore end portion normally upwardly biased by a spring 7*c*, and the letter P designates sheet materials supported on the cassette intermediate plate 7*b* and contained in the cassette box 7*a*. In the mounted condition of the cassette 7, the leading ends of the supported sheet materials P are positioned below the paper feeding roller 1, and the upper surface of the leading end portion of the uppermost one of the supported sheet materials P is kept in pressure contact with the lower surface portion of the paper feeding roller 1 or the lower surface portion of the auxiliary roller 2 by the upward biasing force of the spring 7*c* with a predetermined pressure force.

One full rotation intermittent driving of the paper feeding roller 1 in the clockwise direction is effected by a paper feeding signal and the peripheral surface 1*c* of the paper feeding roller 1 comes into contact with the upper surface of the leading end portion of the uppermost one of the supported sheet materials P, whereby a paying-away force acts on the uppermost sheet material, which is thus fed out of the cassette 7 to between the paper feeding roller 1 and the friction member 3 which is in pressure contact with the surface of the roller 1. The uppermost sheet material thus fed out is conveyed between the contact portions of the paper feeding roller 1 and the friction member 3 by the rotational force of the paper feeding roller 1.

As the uppermost sheet material is paid away or conveyed by the continued paper feeding, the next sheet material and so forth are dragged due to the frictional force therebetween and by the movement of the uppermost sheet material and are gradually moved forward out of the cassette 7. Thus, as shown in FIG. 9A of the accompanying drawings, the leading end portions of the sheet materials heapingly come into a wedge-shaped space M formed by the paper feeding roller 1 and the friction member 3 upstream with respect to the direction of conveyance of the sheet materials. However, even in such a state, only the uppermost sheet material that is in direct contact with the paper feeding roller 1 is handled by the rotational force of the paper feeding roller 1 and passes between the contact portions of the paper feeding roller 1 and the friction member 3, and the next sheet materials and so forth are precluded from moving forward by the frictional force of the friction member 3 and do not move forwardly of the contact portions of the paper feeding roller 1 and the friction member 3.

That is, only the uppermost one of the supported sheet materials P passes between the paper feeding roller 1 and the friction member 3 without causing the trouble of double feeding with respect to the next sheet material and so forth and thus, the sheet materials are separated one by one and conveyed to a sheet material processing portion such as an image forming portion through a sheet path formed by guide plates 5, 5A and 5B.

The paper feeding roller 1, when driven for one full rotation, is stopped from rotating in a rotational angle state in which the cut-away planar portion thereof faces downward, but until then, the leading end portion of the uppermost sheet material conveyed by the paper feeding roller 1 toward the sheet material processing portion through the sheet path formed by the guide plates 5, 5A and 5B is nipped between a pair of relay conveying rollers (not shown), and thereafter the conveyance of the sheet material is continuedly done by the conveying force of the pair of relay conveying rollers. The trailing end portion of the sheet material passes in a pulling-out fashion between the auxiliary roller 2 and the friction member 3 while rotating the auxiliary roller 2 about the shaft 1*a*.

The auxiliary roller 2 serves to keep the paper feeding roller 1 apart from the friction member 3 so as not to contact with the sheet materials P when during non-feeding, the paper feeding roller 1 is being stopped from rotating in the rotational angle state in which the cut-away planar portion faces downward.

Even if as described previously in connection with FIG. 9A, the leading end portions of a plurality of sheet materials heapingly come into the wedge-shaped space M formed by the paper feeding roller 1 and the friction member 3, the direct contact between the paper feeding roller 1 and the friction member 3 is kept in almost all cases until the uppermost sheet material which is in direct contact with the paper feeding roller 1 wedges into the contact portions of the roller 1 and the member 3. Also, when the friction resistance between the paper feeding roller 1 and the sheet material P is C and the friction resistance between the friction member 3 and the sheet material P is D and the friction resistance between the adjacent sheet materials P is E, these three friction resistances are kept in the relation that $C>D>E$, and the performance of separating the sheet materials one by one is not reduced.

However, where sheet materials of high mutual friction resistance are used as the sheet materials P, the force with which the leading end portions of the plurality of sheet materials wedge into the aforementioned wedge-shaped space becomes strong. In that case, said wedging force overcomes the pressure contact force by the spring 6 of the separating unit 4 against the paper feeding roller 1, and the separating unit 4 is pushed down away from the surface of the paper feeding roller 1 against the force of the spring 6. Thus, the amount of wedging of the leading end portions of the plurality of sheet materials into the wedge-shaped space M becomes excessively great, and as shown in FIG. 9B of the accompanying drawings, the friction member 3 of the separating unit 4 separates from the surface of the paper feeding roller 1 to thereby create a gap δ therebetween.

When such a gap δ is created, the force with which the sheet materials (the second and subsequent sheet materials) underlying the uppermost sheet material (the first sheet material) directly contacted by the paper feeding roller 1 is urged against the friction member 3 is reduced or disappears downstream of the friction member 3 with respect to the direction of conveyance of the sheet materials. Therefore, the separated state of the friction member 3 from the sheet materials is deteriorated and thus, the second and subsequent sheet materials are fed past and between the paper feeding roller 1 and the friction member 3 with the first sheet material. That is, the trouble of double feeding of the sheet materials is caused.

The problem as noted above arises even in the sheet separating device as disclosed in U.S. Pat. No. 4,032,135 which has a paper feeding roller discretely from a roller cooperating with a friction member to effect separation of sheets.

SUMMARY OF THE INVENTION

In view of the above-described circumstances, the present invention has as its object to provide a sheet material separating device of this type which is contrived so that even where the friction resistance between sheet materials P used is high and the force with which the leading end portions of a plurality of sheet materials wedge into the wedge-shaped space M between the paper feeding roller 1 and the friction member 3 is strong, the contact state between the paper feeding roller 1 and the friction member 3 is secured without the gap δ being created, whereby ensuring the action of stably separating the sheet materials one by one to be maintained without the trouble of double feeding of the sheet materials.

To achieve the above object, the sheet separating device of the present invention has a sheet material conveying member for conveying sheet materials in a predetermined direction, and a sheet material separating member urged against the surface of said sheet material conveying member with a predetermined pressure force. Of two or more sheet materials whose leading end portions have entered between said two members due to the cooperation between said two members, the sheet material which is in direct contact with the sheet material conveying member is conveyed between the contact portions of said two members by the conveying force of the sheet material conveying member and the passage of the other sheet materials is precluded by the sheet material separating member, whereby the sheet materials are separated and conveyed one by one. Here, said sheet material separating member is provided for pivotal movement about an axis orthogonal to the direction of conveyance of the sheet materials and parallel to the direction of the surfaces of the sheet materials.

Thus, according to the above-described sheet separating device, the sheet material separating member provided in pressure contact with the sheet material conveying member is made pivotable, whereby even where the friction resistance between the sheet materials used is high and the force with which the leading end portions of a plurality of sheet materials wedge into the wedge-shaped space formed by said two members becomes strong, the sheet material separating member pivots about said axis in conformity with the wedging force (although the position of the portion of contact of the sheet material separating member with the surface of the sheet material conveying member is changed by that pivotal movement), whereby the two members are kept in contact with each other without creating a gap therebetween. Accordingly, the trouble of double feeding of the sheet materials is prevented and the performance of stably separating the sheet materials one by one can always be maintained.

DESCRIPTION OF THE PREFERRED EMBODIMENTS

Figure 1:
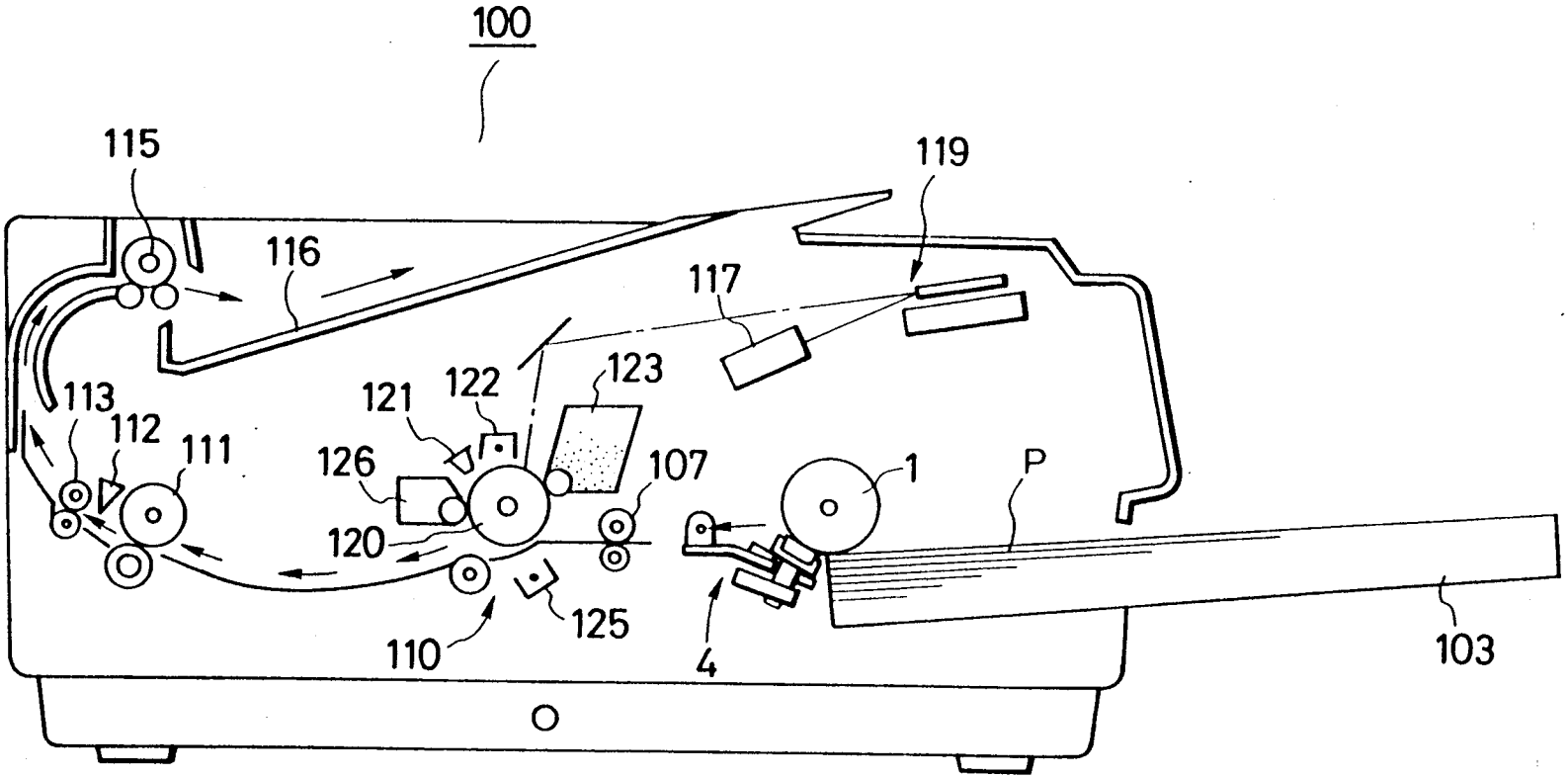
FIG. 1 is an illustration of an image forming apparatus to which the present invention is applied.

FIG. 1 shows a longitudinal cross-sectional view of an image recording apparatus (for example, a laser beam printer) 100 to which the present invention is applied.

The laser beam printer 100 as the image recording apparatus, as shown in FIG. 1, has a cassette 103 containing sheet materials P therein, a paper feeding roller 1 for feeding the sheet materials P from the cassette 103, and register rollers 107 disposed downstream of the paper feeding roller 1 for synchronously conveying the sheet materials P. Disposed downstream of the register rollers 107 is an image forming portion 110 for forming images by a laser beam from a laser scanner portion 109. A fixating device 111 is disposed downstream of the image forming portion 110, and a discharged paper sensor 112 is disposed downstream of the fixating device 111.

A pair of conveying rollers 113 and a pair of paper discharge rollers 115 are disposed downstream of the discharged paper sensor 112, and a paper discharge tray 116 is disposed downstream of the pair of paper discharge rollers 115. The laser scanner portion 109 is comprised of a laser unit 117 emitting a laser beam, and a polygon motor 119 for causing the laser beam from the laser unit 117 to scan. Further, the image forming portion 110 is comprised of a photosensitive drum 120, an exposure lamp 121, a primary charger 122, a developing device 123, a transfer charger 125 and a cleaner 126.

A separating unit 4 provided at a location opposed to the paper feeding roller 1 will now be described with reference to FIGS. 2–4.

Figure 2:
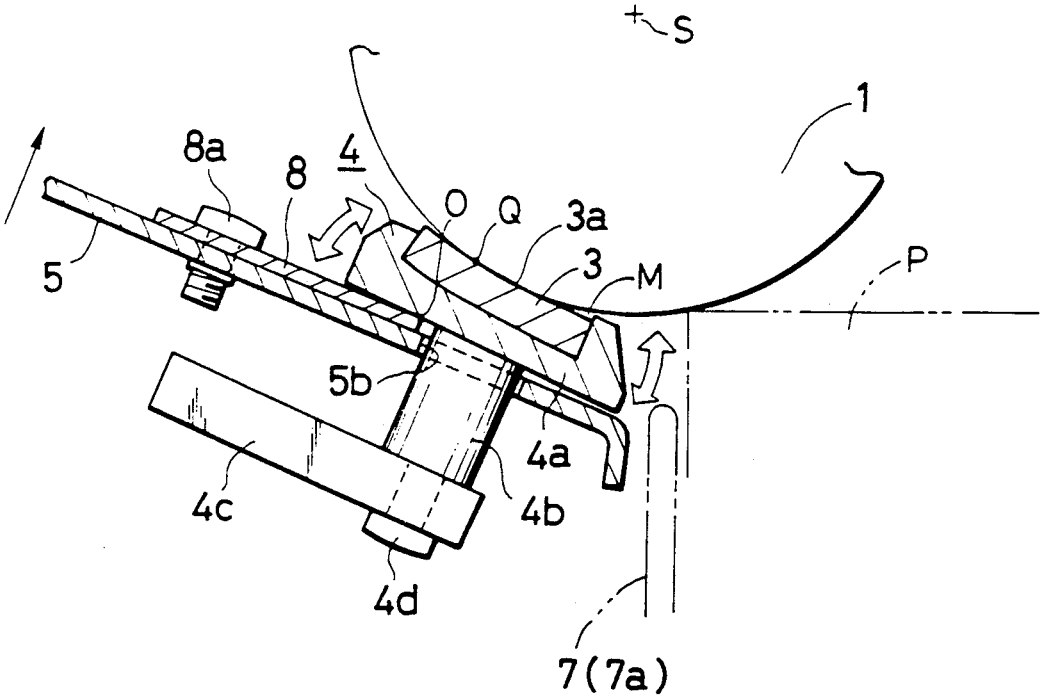
FIG. 2 is a longitudinal cross-sectional view of the essential portions of a first embodiment of the present invention.
Figure 3:
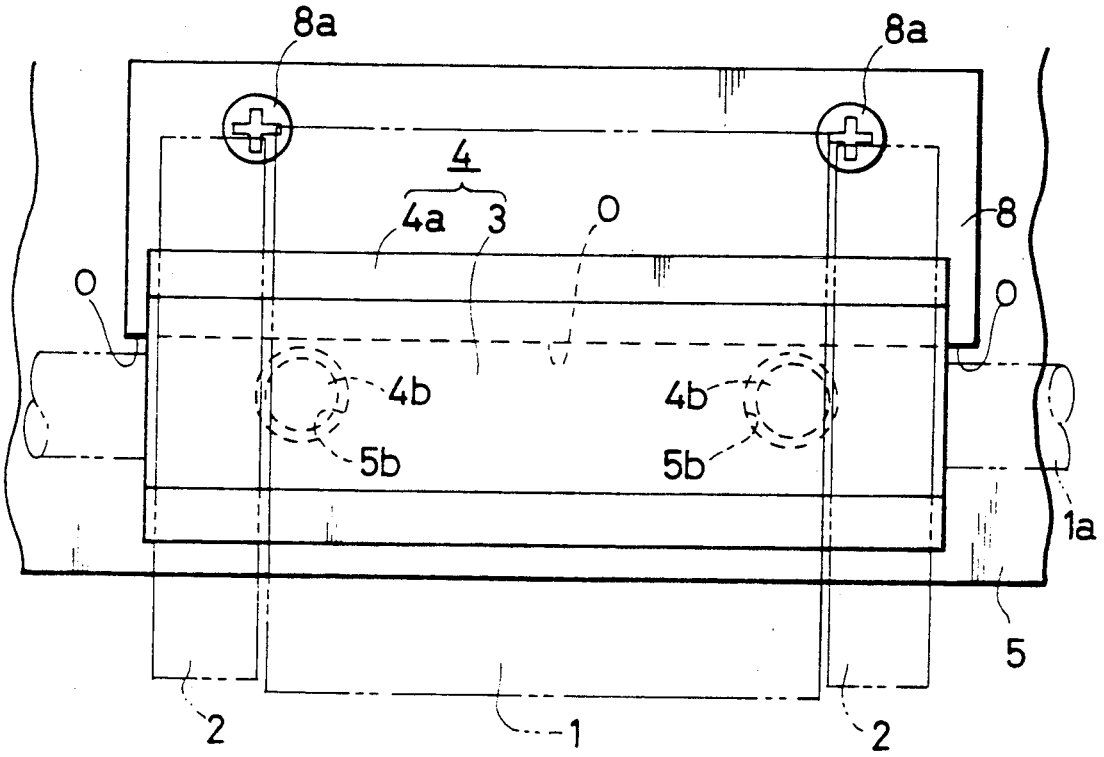
FIG. 3 is a plan view of a separating unit.
Figure 4:
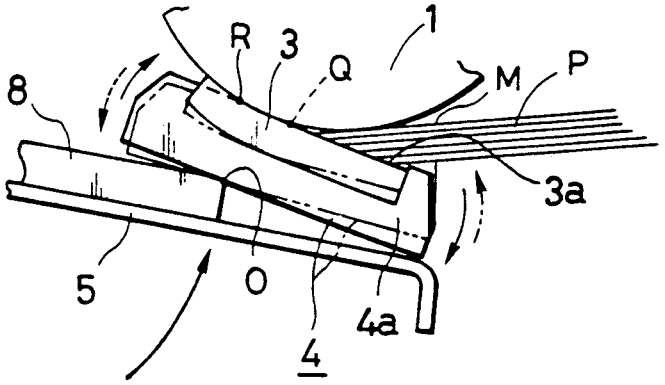
FIG. 4 is a schematic view for illustrating the action of the separating unit when sheet materials are fed.

FIG. 2 is a longitudinal cross-sectional view of the essential portions of the apparatus shown in FIG. 1, FIG. 3 is a plan view of the separating unit portion, and FIG. 4 shows the whole of the sheet material separating device. In these figures, members and portions common to those in the device shown in FIG. 8 are given similar reference numerals and need not be described again.

In the present embodiment, the separating unit 4 is provided with downwardly protruding boss portions **4*b* provided at two locations on the back surface of the pedestal 4*a* thereof adjacent to the opposite ends thereof, and through-apertures 5*b* corresponding to the left and right downwardly protruding boss portions 4*b* of the separating unit 4 and provided at two left and right locations on the surface of the extended end portion of a paper feeding guide plate 5, the diameter of the through-apertures 5*b* being a little larger than the diameter of the boss portions 4*b*. The left and right downwardly protruding boss portions 4*b* on the back surface of the separating unit 4 are fitted into the through-apertures 5*b* in the paper feeding guide plate 5 from above the surface of the extended end of the guide plate 5 to thereby support the separating unit 4 on the upper surface portion of the extended end of the paper feeding guide plate 5. A balancer 4*c* is attached to the lower end of each of the left and right boss portions 4*b* protruding downwardly from the through-apertures 5*b* by a screw 4*d*. Downstream of the boss portions 4*b* with respect to the direction of conveyance of the sheet materials, the fore end portion of an equalize plate 8 is inserted between the pedestal 4*a* of the separating unit 4 and the upper surface of the paper feeding guide plate 5, and the equalize plate 8 is fixed to the upper surface of the guide plate 5 by a screw 8*a***.

By being disposed as described above, the separating unit 4 is pivotable in a clockwise direction or a counter-clockwise direction as indicated by arrow in FIG. 2 about the upper edge line 0 of the fore end surface of the equalize plate 8 which is an axis orthogonal to the direction of conveyance of the sheet materials and parallel to the direction of the surfaces of the sheet materials.

Figure 8:
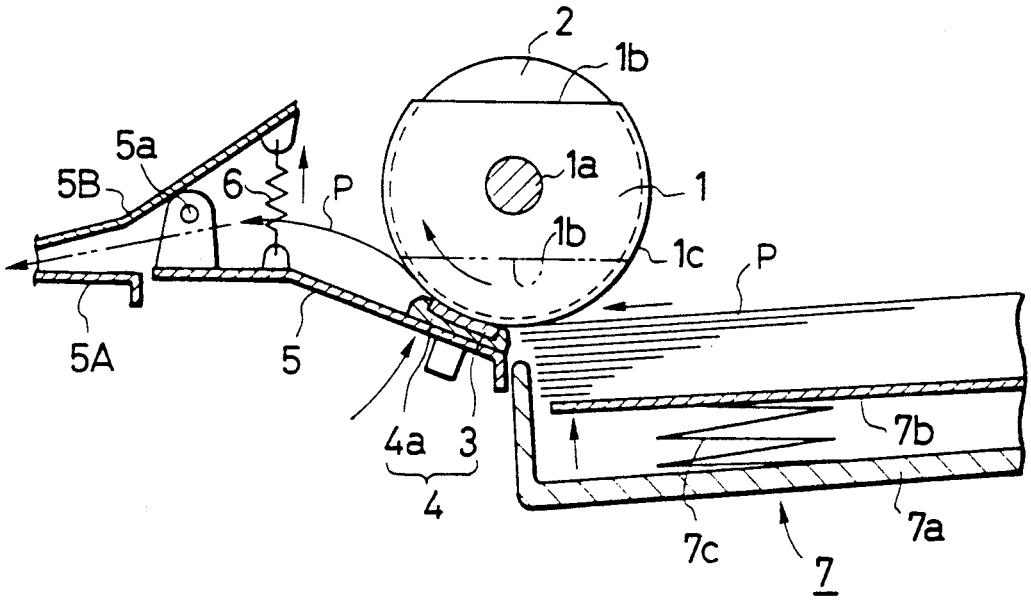
FIG. 8 is a longitudinal cross-sectional view of a sheet material separating device according to the prior art.

The paper feeding guide plate 5 having the separating unit 4 mounted and supported thereon as described above is pivotable about a pivot shaft **5*a* as in the device shown in FIG. 8, and is normally biased for pivotal movement in a raising direction, i.e., a counter-clockwise direction, by a pull-up spring 6. Accordingly, by this biasing force for pivotal movement, the surface of the friction member 3 of the separating unit 4 is kept in pressure contact with the lower surface portion of the paper feeding roller 1 or the lower surface portion of the auxiliary roller 2** with a predetermined pressure force.

When the paper feeding roller 1 is rotatively driven and the peripheral surface **1*c* thereof is in contact with the surface of the friction member 3 of the separating unit 4, the separating unit 4 is nipped between the equalize plate 8 and the paper feeding roller 1 while being subjected to the spring pressure of a spring (FIG. 8) and therefore, at that time, the contact point Q between the friction member 3 and the paper feeding roller 1 is on a straight line passing through a point 0 and the center S of the paper feeding roller 1**.

Figure 5:
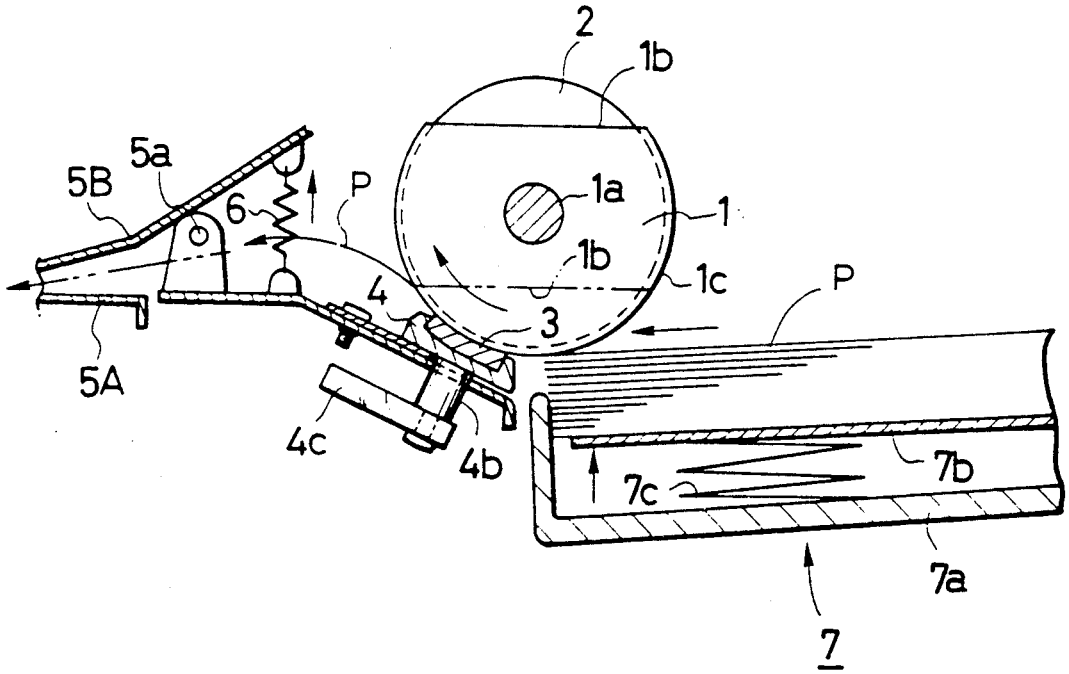
FIG. 5 shows the whole of the separating unit of the first embodiment.

The entire sheet material separating device is shown in FIG. 5, and it is the same as that shown in FIG. 8, except for the sheet separating portion.

FIG. 4 is a schematic illustration for illustrating the action of the separating unit 4 during paper feeding, and eraggeratingly shows some members.

The separating unit 4 is in a posture indicated by broken line in the initial state in which paper feeding is not effected. When sheet materials P having a high friction resistance therebetween are fed and the force with which the leading end portions of a plurality of sheet materials wedge into the wedge-shaped space M between the paper feeding roller 1 and the friction member 3 is strong, the leading end portions of said plurality of sheet materials apply a downward force to the separating unit 4. However, that force does not act as a force which pushes down the paper feeding guide plate 5 about the pivot shaft **5*a* against the force of the spring 6, but acts as a force which pivotally moves the separating unit 4 about the axis 0** in a clockwise direction as indicated by solid line.

Figure 9A:
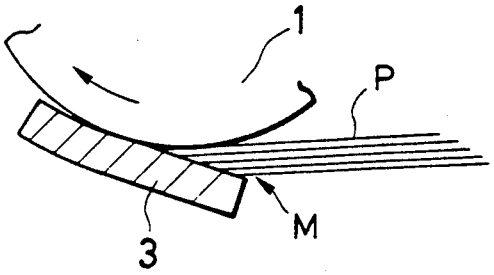
FIG. 9A illustrates the principle of separating sheet materials one by one.
Figure 9B:
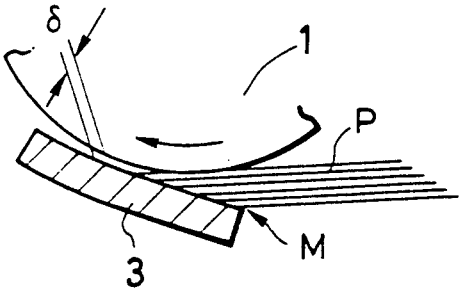
FIG. 9B illustrates the cause of the double feeding of sheet materials.

When the separating unit 4 is pivotally moved as indicated by said solid line, the contact point between the paper feeding roller 1 and the friction member 3 shifts from the position Q to the position R toward the downstream side with respect to the direction of conveyance and the contact between the paper feeding roller 1 and the friction member 3 is kept, so that the gap δ as shown in FIG. 9B is not created therebetween. Accordingly, even if the sheet materials used are sheet materials having a high friction resistance therebetween, the trouble of double feeding of the sheet materials is prevented and the stable performance of separating the sheet materials one by one is always maintained.

The balancer 4c is for changing the natural frequency of the separating unit 4, and prevents the separating unit 4 from causing vibrations and producing a resonant sound during the paper feeding operation.

Also, the friction member 3 is disposed on a line passing through the center S of the paper feeding roller 1 and the pivot O of the friction member. The surface 3a of the friction member 3 which is in contact with the paper feeding roller 1 is a curved surface whose central portion is depressed relative to the upstream side end portion and the downstream side end portion of the sheet.

A second embodiment will now be described with reference to FIG. 6, and this embodiment is the same as the embodiment of FIG. 1 in the construction of the entire image forming apparatus.

Figure 6:
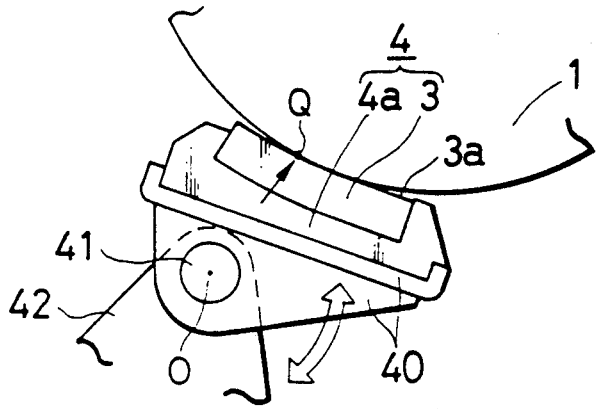
FIG. 6 is a side view of the essential portions of a second embodiment of the present invention.

In the embodiment of FIG. 6, the separating unit 4 is held on a holder 40 which is supported on a support plate 42 for pivotal movement about the axis O of a shaft 41 parallel to the axis of the paper feeding roller 1, through the shaft 41. The support plate 42 is upwardly biased toward the lower surface of the paper feeding roller 1 by a biasing member (not shown), and the surface of the friction member 3 of the separating unit 4 is urged against the lower surface portion of the paper feeding roller 1 with a predetermined pressure force. Again in the present embodiment, the friction member 3 is disposed on a line passing through the center of the paper feeding roller 1 and the pivot O of the friction member 3.

This construction can also obtain an operational effect similar to that of the previous embodiment.

Figure 7:
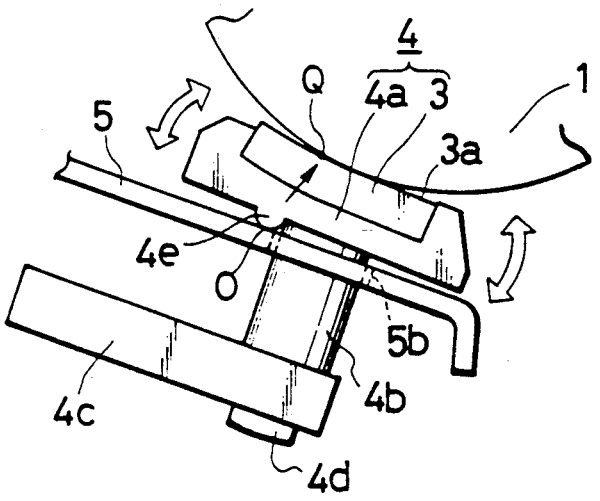
FIG. 7 is a side view of the essential portions of a third embodiment of the present invention.

A third embodiment is shown in FIG. 7, and this embodiment is the same as the embodiment of FIG. 1 in the construction of the entire image forming apparatus.

In the embodiment of FIG. 7, instead of the equalize plate 8 in the first embodiment, a downward fulcrum projection 4e which is in contact with the upper surface of the paper feeding guide plate 5 is integrally provided on the lower surface of the pedestal 4a of the separating unit 4, and the separating unit 4 is made pivotable about the contact point O between the lower end of the fulcrum projection 4e and the upper surface of the paper feeding guide plate 5.

Again in the present embodiment, the friction member 3 is disposed on a line passing throught the center of rotation of the paper feeding roller 1 and the pivot O of the friction member 3.

This construction can also obtain an operational effect similar to that of the first embodiment.

The present embodiment eliminates the equalize plate 8 and the set screw 8a therefore, and has the advantage that the number of parts can be decreased.

While in the above-described embodiments, the sheet material conveying member is the feeding and separating roller, the present invention is also applicable to a paper feeding system having a feeding roller and a separating roller discretely from each other. Also, the sheet material conveying member is not limited to a rotatable roller, but may also be a belt member or a web member which is movable round.

We claim:

1. A sheet material separating device having:

a rotatable conveying member for conveying sheet materials in a predetermined direction;

a separating member opposed to said rotatable conveying member to form a nip therebetween and prohibiting passage of the sheet materials other than the sheet material which is in direct contact with said rotatable conveying member and conveyed thereby; and a support member for supporting said separating member so that the point of contact between said rotatable conveying member and said separating member is shifted downstream in relation to the conveying direction of the sheet materials when the sheet materials enter into the nip formed between said rotatable conveying member and said separating member.

2. A sheet material separating device according to claim 1, wherein said rotatable conveying member includes a roller.

3. A sheet material separating device according to claim 1, wherein said separating member prohibits the passage of the sheet materials by a frictional force.

4. A sheet material separating device according to claim 1, wherein said separating member is comprised of a friction member frictionally contacting said rotatable conveying member, and a pedestal for supporting said friction member.

5. A sheet material separating device according to claim 1, wherein said support member supports said separating member for pivotal movement about an axis orthogonal to the direction of conveyance of the sheet materials and parallel to the surface of the sheet material being conveyed.

6. A sheet material separating device according to claim 5, wherein said separating member is disposed on a line passing through the pivot of said separating member and the center of rotation of said rotatable conveying member.

7. A sheet material separating device according to claim 1, further having a pivotable member for supporting said support member.

8. A sheet material separating device according to claim 7, further having a resilient member for biasing said pivotable member to urge said separating member against said rotatable conveying member.

9. A sheet material separating device according to claim 7, wherein said pivotable member has a guide portion for guiding the sheet materials being conveyed.

10. A sheet material separating device having:

conveying means for conveying sheet materials in a predetermined direction;

a separating member opposed to said conveying means to form a nip therebetween and prohibiting passage of the sheet materials other than the sheet material which is in direct contact with said conveying means and conveyed thereby; and a support member for supporting said separating member so that the point of contact between said conveying means and said separating member is shifted downstream in relation to the conveying direction of the sheet materials when the sheet materials enter into the nip formed between said conveying means and said separating member.

11. A sheet material separating device according to claim 10, wherein said support means supports said separating means for pivotal movement about an axis orthogonal to the direction of conveyance of the sheet materials and parallel to the surface of the sheet material being conveyed.

12. A sheet material separating device according to claim 11, wherein said conveying means includes a rotatable roller.

13. A sheet material separating device according to claim 12, wherein said separating means is disposed on a line passing through the pivot of said separating means and the center of rotation of said roller.

14. A sheet material separating device having:

a rotatable conveying member for conveying sheet materials in a predetermined direction;

a friction member opposed to said rotatable conveying member to form a nip therebetween and precluding passage of the sheet materials other than the sheet material which is in direct contact with said rotatable conveying member and conveyed thereby by frictional force;

a pedestal for holding said friction member thereof; and a support bed having a supporting point disposed along an axis orthogonal to the direction of conveyance of the sheet materials and parallel to the direction of the sheet material being conveyed, and supporting said pedestal by said pedestal being placed on said supporting point, said support bed supporting said pedestal so that the point of contact between said rotatable conveying member and said friction member is shifted downstream in relation to the conveying direction of the sheet materials when the sheet materials enter into the nip formed between said rotatable conveying member and said friction member.

15. A sheet matrieal separating device according to claim 14, wherein said friction member is disposed on a line passing through said supporting point of said support bed and the center of rotation of said rotatable conveying member.

16. A sheet material separating device according to claim 14, wherein said friction member has a curved surface whose central portion in the direction of conveyance of the sheet materials is depressed.

17. A sheet material separating device according to claim 14, wherein said support bed includes a plate-like member.

18. A sheet material separating device according to claim 17, wherein said supporting point is disposed on an edge line of said plate-like member.

19. A sheet material separating device according to claim 18, further having a pivotable member for supporting said plate-like member.

20. A sheet material separating device according to claim 19, further having a resilient member for biasing said pivotable member to urge said friction member against said rotatable conveying member.

21. A sheet material separating device according to claim 20, wherein said pivotable member has a guide portion for guiding the sheet materials being conveyed.

22. An image forming apparatus having:

a rotatable conveying member for conveying sheet materials in a predetermined direction;

a separating member opposed to said rotatable conveying member to form a nip therebetween and prohibiting passage of the sheet materials other than the sheet material which is in direct contact with said rotatable conveying member and conveyed thereby;

a support member for supporting said separating member so that the point of contact between said rotatable conveying member and said separating member is shifted downstream in relation to the conveying direction of the sheet materials when the sheet materials enter into the nip formed between said rotatable conveying member and said separating member;

image forming means for forming images on the sheet material conveyed by said rotatable conveying member; and a conveying member for conveying the sheet material on which images have been formed by said image forming means.

23. A sheet material separating device, having:

a rotatable conveying member for conveying sheet materials in a predetermined direction;

a separating member comprising a friction member frictionally contacting said rotatable conveying member, and a pedestal for supporting said friction member; and a support member including a plate-like member and supporting said separating member so that said separating member is rotatable about an edge of the plate-like member, said support member causing said separating member to rotate about the edge so that the point of contact between said friction member and said rotational conveying member is shifted downstream in relation to the conveying direction of the sheet materials when the sheet materials enter into a nip between said rotational conveying member and said separating member, thereby inhibiting passing of the sheet materials other than the sheet material to be conveyed.

* * * * *

UNITED STATES PATENT AND TRADEMARK OFFICE

CERTIFICATE OF CORRECTION

PATENT NO. : 5,104,113

DATED : April 14, 1992

INVENTOR(S) : Toru KAMEYAMA, ET AL.

It is certified that error appears in the above-identified patent and that said Letters Patent is hereby corrected as shown below:

COLUMN 1,
Line 16, "sheets)" should read --sheets--.

COLUMN 2,
Line 27, "paying-away" should read --putting-away--.

COLUMN 6,
Line 48, "eraggeratingly" should read --exaggeratingly--.

COLUMN 9,
Line 39, "matrieal" should read --material--.

Signed and Sealed this

Twentieth Day of July, 1993

*Attest:*

Michael K. Kirk

MICHAEL K. KIRK

*Attesting Officer*

*Acting Commissioner of Patents and Trademarks*